US006133690A

United States Patent [19]

Meyer et al.

[11] Patent Number: 6,133,690

[45] Date of Patent: Oct. 17, 2000

[54] DISPLAY SCREEN COMPRISING A SOURCE OF ELECTRONS WITH MICROTIPS, CAPABLE OF BEING OBSERVED THROUGH THE MICROTIP SUPPORT, AND METHOD FOR MAKING THIS SOURCE

[75] Inventors: Robert Meyer, Nazaire les Eymes; Marie-Noëlle Semeria, St Nizier; Brigitte Montmayeul, Bernin, all of France

[73] Assignee: Commissariat a l'Energie Atomique, Paris, France

[21] Appl. No.: 09/319,240

[22] PCT Filed: Dec. 5, 1997

[86] PCT No.: PCT/FR97/02216

§ 371 Date: Jun. 7, 1999

§ 102(e) Date: Jun. 7, 1999

[87] PCT Pub. No.: WO98/25291

PCT Pub. Date: Jun. 11, 1998

[30] Foreign Application Priority Data

Dec. 6, 1996 [FR] France ..... 96 15012

[51] Int. Cl.[7] ..... H01J 31/12; H01J 9/02

[52] U.S. Cl. ..... 313/495; 313/497; 313/309; 313/336; 313/351; 313/461; 445/24; 445/42

[58] Field of Search ..... 313/495, 496, 313/497, 309, 336, 351, 461; 445/25, 35, 38, 42, 51, 53, 56, 24

[56] References Cited

U.S. PATENT DOCUMENTS

| | | | |
|---|---|---|---|
| 4,908,539 | 3/1990 | Meyer . | |
| 4,940,916 | 7/1990 | Borel et al. . | |
| 5,396,150 | 3/1995 | Wu et al. . | |
| 5,534,744 | 7/1996 | Leroux et al. | 313/309 |
| 5,574,333 | 11/1996 | Clerc . | |
| 5,578,225 | 11/1996 | Chien . | |

FOREIGN PATENT DOCUMENTS

| | | |
|---|---|---|
| 0 541 394 A1 | 5/1993 | European Pat. Off. . |
| 0 558 393 A1 | 9/1993 | European Pat. Off. . |
| 0 668 604 A1 | 8/1995 | European Pat. Off. . |
| WO 92/00600 | 1/1992 | WIPO . |

*Primary Examiner*—Ashok Patel
*Attorney, Agent, or Firm*—Oblon, Spivak, McClelland, Maier & Neustadt, P.C.

[57] ABSTRACT

A display screen which includes a microtip electron source which is observerable through the microtip support. The screen includes a cathodoluminescent anode, transparent support and cathode conductors formed on the support. The conductors are meshed according to a first pattern which includes openings. A resistive layer formed on the support is meshed according to a second pattern and includes solid areas located in the openings of the first pattern. Microtips are formed on the solid areas. Grids are meshed according to the second pattern in an unmeshed insulating layer which is transparent and extends above the cathode conductors and the resistive layer in between them and the grids.

7 Claims, 3 Drawing Sheets

DISPLAY SCREEN COMPRISING A SOURCE OF ELECTRONS WITH MICROTIPS, CAPABLE OF BEING OBSERVED THROUGH THE MICROTIP SUPPORT, AND METHOD FOR MAKING THIS SOURCE

BACKGROUND OF THE INVENTION

1. Field of the Invention

This invention relates to a display device by cathodoluminescence excited by field emission, or cold emission, and more precisely a display screen comprising a microtips electron source observable through the microtips support and a process for manufacturing this source.

The invention is particularly applicable to the manufacture of matrix display devices for the display of fixed or animated images.

A screen conform with the invention comprises a partially transparent cathode structure.

Remember that the advantage of this type of partially transparent cathode structure is that it can be used to observe phosphors on the screen on the same side as the electrons that excite them, thus recovering more light and thus improving the light efficiency of the screen.

2. Discussion of the Background

The principle by which phosphors are observed from the side on which they are excited is known.

It is used particularly for VFD (Vacuum Fluorescent Display) devices.

The only difference between these devices and microtip screens is the method of emitting electrons.

FIG. 1 in the attached drawings diagrammatically shows the structure of a VFD.

In this VFD, an electrically insulating substrate P1 and a glass plate P2 delimit an area Z in which the vacuum is created and which is closed along its periphery by a sealed material M.

The area Z contains heating filaments F capable of emitting electrons by thermionic effect.

Cathode conductors C made of aluminum are formed on the substrate P1 facing these heating filaments F, and are covered with phosphors P.

Light L emitted by these phosphors is observed at 0 through the glass plate P2.

Furthermore, a grid G placed between the heating filaments F and the cathode conductors C modulates the electronic current.

The principle mentioned above has also been used in the recent past for plasma color display screens.

Document (1) French patent application deposited on Jul. 27, 1984 No. 8411986 also describes a microtips screen structure in which the phosphors are observed on the side on which they are excited.

Document (2) international application PCT/US91/04491 by COLORAY DISPLAY CORPORATION, international publication number WO92/00600, describes the observation of phosphors from the side on which they are excited through a "transparent" cathode in a microtips screen.

The structure described in this document (2) is composed of metallic rows and columns which are placed at a sufficient spacing so that the cathode can transmit 80% of the light.

Under these conditions, the area covered by the microtips only occupies 1% of the area of the cathode, which considerably reduces the average effect and makes higher addressing voltages necessary to obtain the necessary electronic current.

Furthermore, this cathode does not have a meshed structure or a resistive layer.

A display screen with a partially transparent cathode provided with a resistive and meshed structure is described in document (3) French patent application No. 9202220 Feb. 26, 1992 (FR-A-2687839) corresponding to EP-A-0558393 and the American patent application Ser. No. 08/022,935 (Leroux et al.), Feb. 26, 1993.

This document (3) is included in this description by reference.

The partially transparent cathode described in this document (3) is based on a perforated grid structure associated with a transparent resistive layer.

This is shown in FIGS. 5 and 6 in document (3).

This type of structure requires the development of a resistive material that must have a suitable resistivity (of the order of $10^3$ to $10^4$ Ω.cm) and a high transmission in the visible range (greater than 80%).

This material is difficult to make and particularly difficult to reproduce in a controlled and uniform manner on large areas.

SUMMARY OF THE INVENTION

The purpose of this invention is to overcome the disadvantages mentioned above by proposing a microtips display screen observable through the microtips support, this screen having cathode conductors and grids with a meshed structure and a resistive layer with a mesh in the same pattern as the grid.

This invention thus makes it possible to use a resistive layer that is not necessarily transparent.

More precisely, the purpose of this invention is a display screen characterized in that it comprises:

- a cathodoluminescent anode comprising:
  - a first support,
  - at least one anode conductor formed on this first support,
  - at least one cathodoluminescent material formed on this anode conductor, and
- a microtips electron source comprising:
  - a second support, one face of which is placed facing the cathodoluminescent material, and which is transparent to light that may be emitted by this cathodoluminescent material,
  - cathode conductors formed on the said face of this second support and meshed according to a first pattern including openings,
  - a resistive layer formed on the said face of the second support, meshed according to a second pattern, and including solid areas placed in openings in the first pattern,
  - microtips formed on these solid areas,
  - electrically conducting grids that are meshed according to the second pattern, and
  - an unmeshed electrically insulating layer that is transparent to the said light and extends above the cathode conductors and the resistive layer, between them and the grids.

In this invention, the resistive layer may be transparent to the said light, or it may be opaque to it.

For example, this resistive layer may be made of amorphous silicon, $Cr_2O_3$, or silicon carbide SiC, or CrSiO.

According to one preferred embodiment of the display screen according to the invention, a layer capable of preventing light incoming from outside the screen from being reflected on this layer, is inserted between the second support and the cathode conductors and between the second support and the resistive layer.

This layer capable of preventing reflection may be placed entirely under the resistive layer or only under the solid areas of the resistive layer, and in this case an electrically conducting material can be used, otherwise it would have to have a higher resistance than the resistive layer.

Preferably, the anode conductor comprises electrically conducting tracks parallel to the cathode conductors.

The anode conductor may comprise a material that reflects light, for example aluminum.

This invention also relates to a process for manufacturing the microtips electron source forming part of the display screen according to the invention, characterized in that the cathode conductors are formed with a mesh according to the first pattern, the resistive layer is formed with a mesh according to the second pattern, the insulating layer is formed, a grid layer is formed on this insulating layer, the holes designed to contain microtips are formed in this grid layer and the insulating layer, these microtips are formed, and the grids with a mesh according to the second pattern are formed starting from the grid layer.

BRIEF DESCRIPTION OF THE DRAWINGS

This invention will be better understood after reading the following description of example embodiments given for illustrative purposes only and in no way restrictive, with reference to the attached drawings in which.

DETAILED DESCRIPTION OF PARTICULAR EMBODIMENTS

A display screen according to the invention comprises a cathodoluminescent anode and a microtips electron source facing this anode, which is partially transparent to light that may be emitted by the cathodoluminescent anode.

This microtips electron source comprises a meshed resistive structure of the type described in document (3), but using a resistive material which does not need to be transparent and which can therefore be opaque, for example such as amorphous silicon.

An essential difference between this source and the microtips electron source that is described in document (3) is that in the case of the source for a screen according to this invention, the resistive layer is meshed according to the pattern of the perforated grids forming part of this source, whereas the resistive layer of the source described in document (3) is not meshed.

This is why the resistive material used in this invention does not need to be transparent to light that may be emitted by the microtips electron source, which makes it easier to make the display screen according to the invention.

The principle of etching a resistive layer is described in document (4) French patent application No. 87 15432, Nov. 6, 1987 corresponding to U.S. Pat. No. 4,940,916 which should be referenced.

Figure 5:
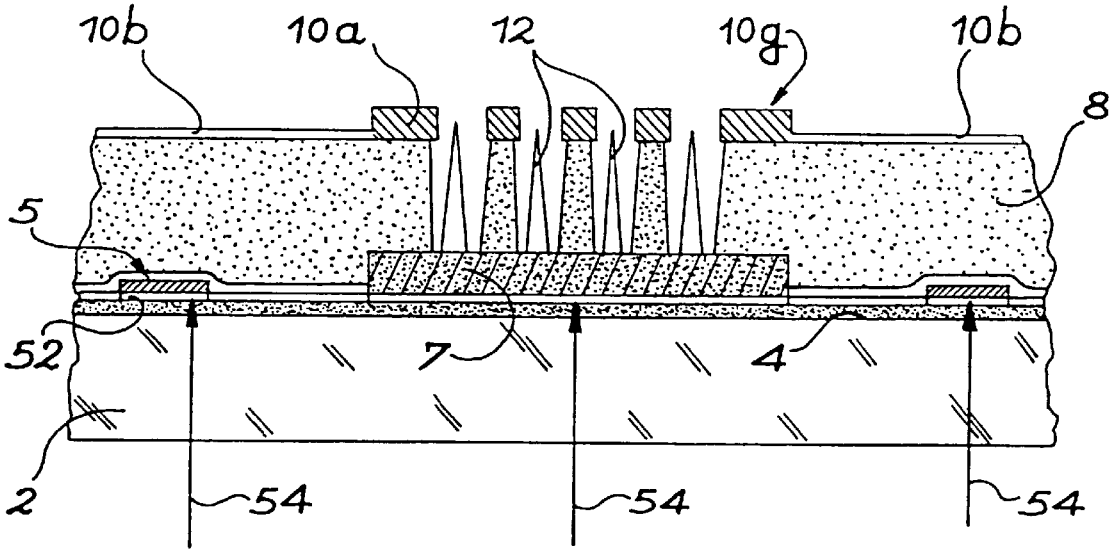
FIG. 5 is a diagrammatic sectional view of another display screen according to the invention.

In the description of FIG. 5 in this document (4), a resistive iron oxide layer is etched between the cathode conductors of a display screen in order to better insulate these cathode conductors from each other.

In one process for manufacturing a display screen according to the invention, a layer of resistive material, such as for example a layer of amorphous silicon, is etched inside the meshes formed by the cathode conductors and in accordance with the pattern of the display screen grids.

This etching does not perform any electrical role.

An attempt was simply made using this etching to assign a certain transmission to the microtips electron source on the display screen.

Figure 1:
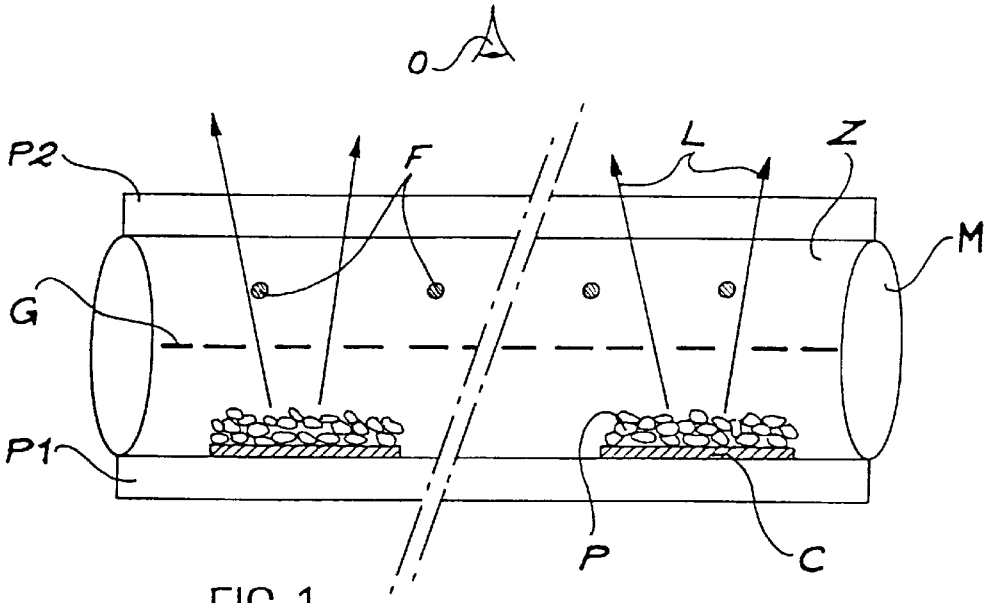
FIG. 1 already described is a diagrammatic view of a VFD.
Figure 2:
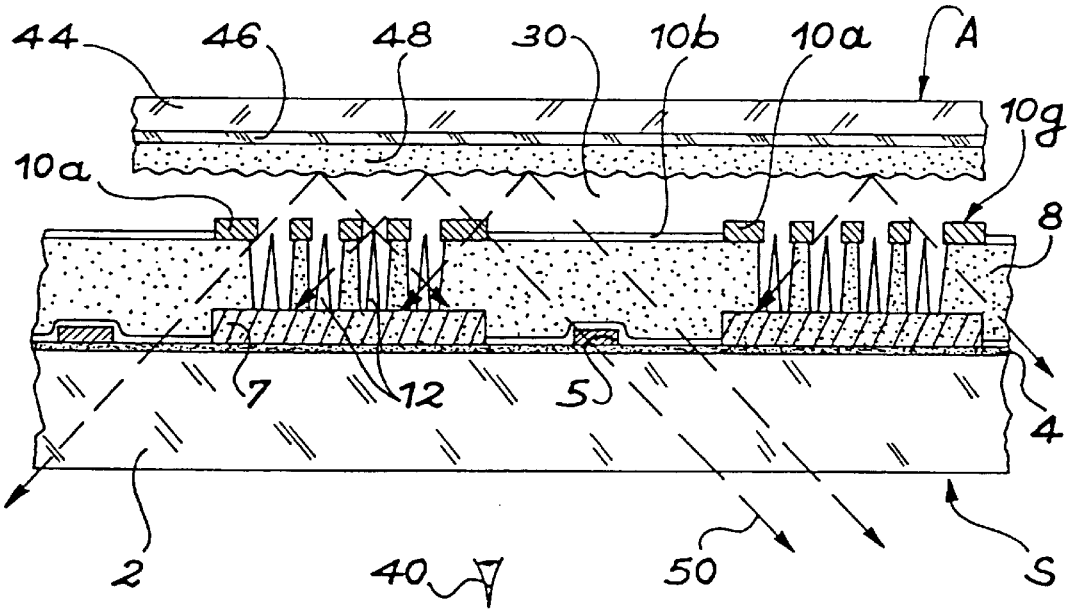
FIG. 2 is a diagrammatic sectional view of a display screen according to the invention.
Figure 3A:
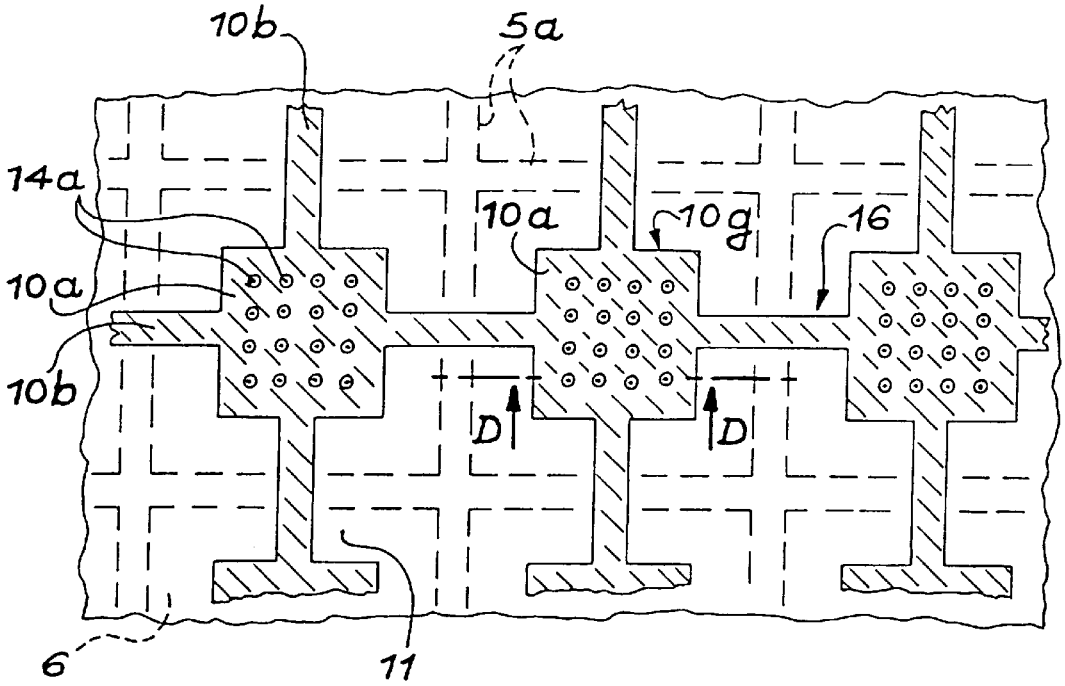
FIG. 3A is a diagrammatic top view of the microtips electron source forming part of the screen in FIG. 2.
Figure 3B:
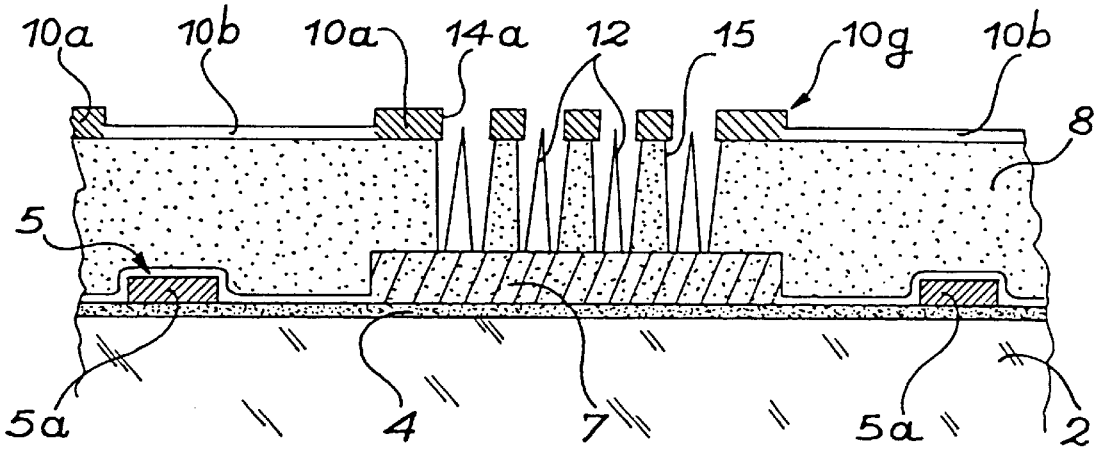
FIG. 3B is a diagrammatic sectional view along DD in FIG. 3A, FIG. 4 diagrammatically illustrates a process for manufacturing a microtips electron source according to the invention.

We will now describe an example display screen according to this invention, with reference to FIGS. 2, 3A, and 3B.

Figure 4:
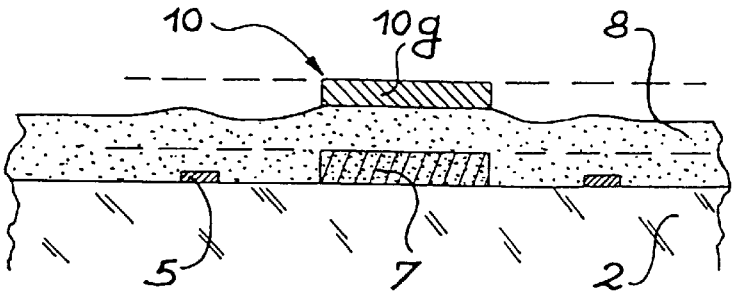

We will then explain an example process according to the invention in order to manufacture this display screen, with reference to FIG. 4.

In order to facilitate understanding of these figures, the same references will be used on these figures as were used in FIGS. 2a, 2b and 5 in document (3) which is integrated into this description by reference, it being understood that FIGS. 2, 3A and 3B of the attached drawings correspond to FIGS. 5, 2a and 2b in this document (3) respectively.

FIG. 3B in the attached drawings is section D—D in FIG. 3A in the attached drawings.

The display screen according to the invention diagrammatically shown in FIGS. 2, 3A and 3B in the attached drawings comprises a microtips electron source S and a cathodoluminescent anode A facing this source S.

This microtips electron source S comprises a support 2 that is transparent to light that may be emitted by the cathodoluminescent material formed on anode A.

For example, this support 2 may be a glass substrate and it may comprise a thin layer of silica 4 on its face facing the cathodoluminescent anode. Cathode conductors 5 are formed on this silica layer 4.

These cathode conductors 5 are meshed according to a first pattern including openings.

In the example shown, each cathode conductor has a lattiqe structure and thus comprises conducting tracks 5*a* which intersect.

Thus, each cathode conductor comprises openings 6 that are delimited by these tracks 5*a*.

A resistive layer 7 is formed on the silica layer 4 and on the cathode conductors.

This resistive layer is meshed according to a second pattern and comprises solid areas placed in openings in the first pattern corresponding to the cathode conductors 5.

In this example, an electrically insulating and unmeshed layer 8 which is transparent to light that may be emitted by anode A and which is consequently made for example of silica, covers the cathode conductors and the resistive layer.

In the example shown, the insulating unmeshed layer is thus inserted between these cathode conductors or the resistive layer and the electrically conducting grids 10*g* that are also included in the microtips electron source S.

These grids 10*g* are also meshed according to the second pattern.

Each of the grids 10*g* is in the approximate form of a lattice.

The lattice for each grid is offset from the lattice for the cathode conductor by a half step parallel to the lines and a half step parallel to the columns of the source, and when viewed from above an area in which the microtips are assembled (FIG. 3A in the attached drawings), this grid has a square surface 10*a* that is perforated by holes 14*a* at which four tracks 10*b* forming part of the lattice of this grid, terminate.

FIG. 3A in the attached drawings includes reference 11 corresponding to openings that perforate the grids.

Microtips reference 12 in FIGS. 2, 3A and 3B in the attached drawings are formed on solid areas in the resistive layer (meshed according to the same pattern as the grids).

The cathodoluminescent anode A comprises a support 44, one or several anode conductors 46 formed on this support 44 facing the microtips electron source of the display screen, and one or several cathodoluminescent materials 48 formed on this (or these) anode conductor(s) 46 facing this source (depending on whether a black and white display or a color display is required).

The anode conductors are preferably made of a material that reflects light (for example aluminum), so that all emitted light goes towards the observer.

A space 30 which will contain a vacuum separates the microtips source S from the cathodoluminescent anode A.

A user 40 of the screen observes light 50 emitted through the cathodoluminescent material(s) of the anode A, through the transparent substrate 2, when this (these) material(s) is (are) struck by electrons emitted by the microtips 12 in the source S.

We will now use FIG. 4 in the attached drawings to explain how to make the microtips electron source for the display screen that has just been described, with reference to FIGS. 2, 3A and 3B in the attached drawings.

The first step is to deposit a layer of (for example) niobium, molybdenum, tungsten, aluminum or copper on substrate 2, and the cathode conductors 5 are then etched from this layer.

The next step is to deposit a resistive layer 7, for example made of amorphous silicon, SiC, $Cr_2O_3$ on the substrate 2, for example by cathode sputtering.

This resistive layer 7 is then etched according to the pattern chosen for it (which is identical to the pattern for the perforated grids).

For example, the thickness of the resistive layer in the case of amorphous silicon may be 1 $\mu$m, and for example it may be etched by reactive ionic etching.

One way that this could be done, but not the only way, is to use equipment marketed by the NEXTRAL company with reference NE550, with the following etching conditions:

etching gas:$O_2$ and $SF_6$, flows: 50 $cm^3$/s for $O_2$ and 50 $cm^3$/s for $SF_6$, pressure: 5 millitorrs (about 0.5 Pa), power: 200 watts duration: 350 seconds.

An electrically insulating layer 8 is then deposited which is transparent to the light that may be emitted by the anode of the screen and for example made of silica, above the cathode conductors 5 and the resistive layer.

A grid layer 10, for example made of niobium, is then deposited on this insulating layer 8 which will be used for the subsequent formation of perforated grids 10*g*.

Holes 15 (FIG. 3B) are then etched in this grid layer and in this insulating layer 8, these holes being designed to hold the microtips 12.

These microtips are then formed.

The next step is to etch the grid layer 10 according to the required pattern to obtain perforated grids 10*g* which are then meshed according to the same pattern as the resistive layer 7.

Spaces are then made around contact connectors on cathode conductors 5.

According to one preferred embodiment illustrated diagrammatically in FIG. 5 in the attached drawings, a layer 52 capable of preventing the reflection of light 54 that could originate from outside the screen on the said layer, is inserted between the glass substrate 2 and the cathode conductors 5 and also between this glass substrate 2 and the resistive layer 7 so as to reduce specular reflections.

For example, this layer 52 could be made of $Cr_2O_3$ or CrSio or oxidized molybdenum.

This layer 52 is deposited on the silica layer 4 and is then etched, for example such that it only remains under the cathode conductors and under the resistive layer.

When the layer 7 is made of CrSiO, it acts as a layer capable of preventing reflection. There is then no need to use a layer 52.

A process for manufacturing a microtips fluorescent screen cathode is already known and is described in document (5) EP0668604A (PIXEL INT SA). This process uses three masking levels which can also give a partially transparent cathode structure. In this cathode structure the insulating layer, the resistive layer and grids are meshed according to the same pattern.

This structure known according to document (5) has a disadvantage, that electrical insulation of the grids from the cathode conductors is not as good as in this structure as it is in the structure described in document (3) due to the meshing of the insulating layer. Consequently, the risks of a short circuit are higher with the structure known according to document (5) than with the structure according to document (3).

This invention overcomes this disadvantage by using the unmeshed insulating layer (but which obviously contains the holes necessary to make the microtips and the openings necessary for operation of the screen, for example like peripheral openings for contacts on cathode conductors). This gives an electrical insulation of the grids with respect to the cathode conductors which is as good as the insulation obtained in the case of the source known according to document (3) and therefore a lower risk of a short circuit than in the case of the structure known according to document (5).

What is claimed is:

1. Display screen characterized in that it comprises:

a cathodoluminescent anode comprising:

a first support, at least one anode conductor formed on this first support, at least one cathodoluminescent material formed on this anode conductor, and a microtips electron source comprising:

a second support, one face of which is placed facing the cathodoluminescent material, and which is transparent to light that may be emitted by this cathodoluminescent material, cathode conductors formed on the said face of this second support and meshed according to a first pattern including openings, a resistive layer formed on the said face of this second support, meshed according to a second pattern, and including solid areas placed in openings in the first pattern, microtips formed on these solid areas, electrically conducting grids that are meshed according to the second pattern, and an unmeshed electrically insulating layer that is transparent to the said light and extends above the cathode conductors and the resistive layer, between them and the grids.

2. Display screen according to claim 1, characterized in that the resistive layer is transparent to the said light or is opaque to it.

3. Display screen according to claim 2, characterized in that the resistive layer is made of amorphous silicon or $Cr_2O_3$ or SiC or CrSiO.

4. Display screen according to any one of claim 1, characterized in that a layer capable of preventing reflection of light arriving from outside the screen on the said layer is inserted between the second support and the cathode conductors, and between this second support and the resistive layer.

5. Display screen according to claim 1, characterized in that the anode conductor contains electrically conducting tracks that are parallel to the cathode conductors.

6. Display screen according to claim 1, characterized in that the anode conductor comprises a material reflecting light, for example aluminum.

7. Process for manufacturing the microtips electron source forming part of the display screen according to claim 1, characterized in that the cathode conductors are formed with a mesh according to the first pattern, the resistive layer is formed with a mesh according to the second pattern, the insulating layer is formed, a grid layer is formed on this insulating layer, the holes designed to contain microtips are formed in this grid layer and the insulating layer, these microtips are formed, and the grids with a mesh according to the second pattern are formed starting from the grid layer.

* * * * *